US007731532B2

(12) United States Patent
Masumoto et al.

(10) Patent No.: US 7,731,532 B2
(45) Date of Patent: Jun. 8, 2010

(54) CONNECTOR

(75) Inventors: Toshio Masumoto, Tokyo (JP); Yuichi Saito, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 564 days.

(21) Appl. No.: 10/585,544

(22) PCT Filed: Jun. 17, 2005

(86) PCT No.: PCT/JP2005/011123

§ 371 (c)(1),
(2), (4) Date: Aug. 16, 2006

(87) PCT Pub. No.: WO2005/124941

PCT Pub. Date: Dec. 29, 2005

(65) Prior Publication Data

US 2008/0287013 A1 Nov. 20, 2008

(30) Foreign Application Priority Data

Jun. 21, 2004 (JP) ..... 2004-183064

(51) Int. Cl.
*H01R 13/648* (2006.01)

(52) U.S. Cl. ..... 439/607; 439/564

(58) Field of Classification Search ..... 439/607, 439/564, 567, 573

See application file for complete search history.

(56) References Cited

U.S. PATENT DOCUMENTS

| | | | | |
|---|---|---|---|---|
| 5,104,326 | A | 4/1992 | Smith et al. | |
| 6,019,632 | A | 2/2000 | Ozai et al. | |
| 6,059,606 | A * | 5/2000 | Okuyama et al. | 439/607 |
| 6,948,980 | B2 * | 9/2005 | Xiang et al. | 439/607 |
| 7,018,237 | B2 * | 3/2006 | Zhan et al. | 439/607 |
| 2003/0109176 | A1 * | 6/2003 | Tsai | 439/607 |
| 2004/0235348 | A1 * | 11/2004 | Murayama | 439/607 |
| 2004/0235349 | A1 * | 11/2004 | Tanaka | 439/607 |

FOREIGN PATENT DOCUMENTS

| | | | |
|---|---|---|---|
| EP | 496082 | A2 | 7/1992 |
| JP | 59-36581 | U | 3/1984 |
| JP | 4-99379 | U | 8/1992 |
| JP | 101 54 557 | A | 6/1998 |
| JP | 10-340761 | | 12/1998 |
| JP | 2000-260528 | | 9/2000 |
| WO | WO 88/08627 | A1 | 11/1988 |

OTHER PUBLICATIONS

International Search Report in English.

* cited by examiner

*Primary Examiner*—Hien Vu
(74) *Attorney, Agent, or Firm*—Collard & Roe, P.C.

(57) ABSTRACT

A connector, comprising a connector body (11) having a flange (19), a shell (17) forming a contour part, and a reinforcement member (53). The reinforcement member (53) further comprises a reinforcement part (67) in contact with the flange (19) in which screw holes (57) are formed and an engagement part (65) engaged with the shell (17). The reinforcement member (53) is detachably fitted to the connector body (11).

2 Claims, 4 Drawing Sheets

[FIG. 1]
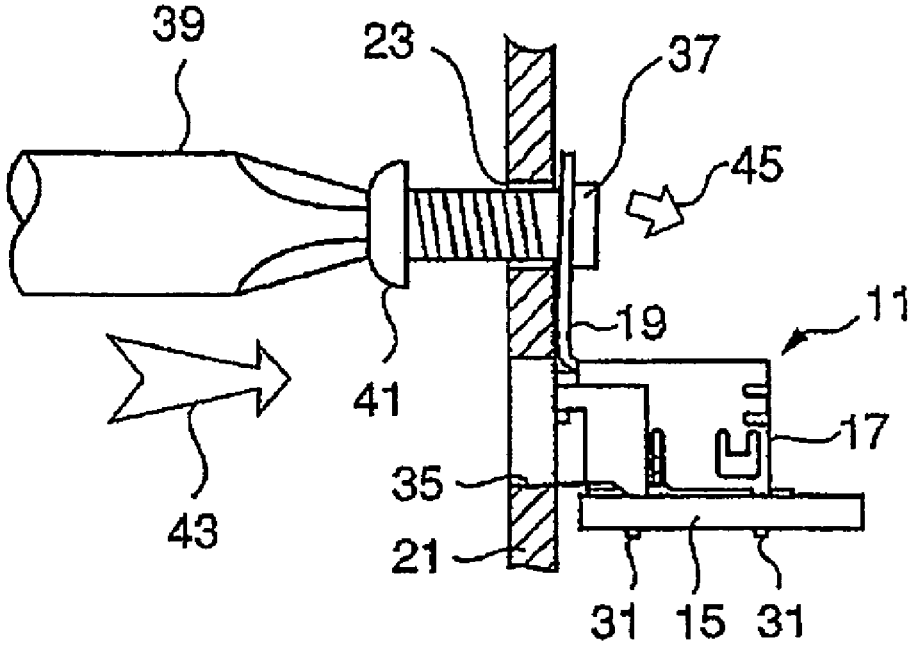
[FIG. 2]
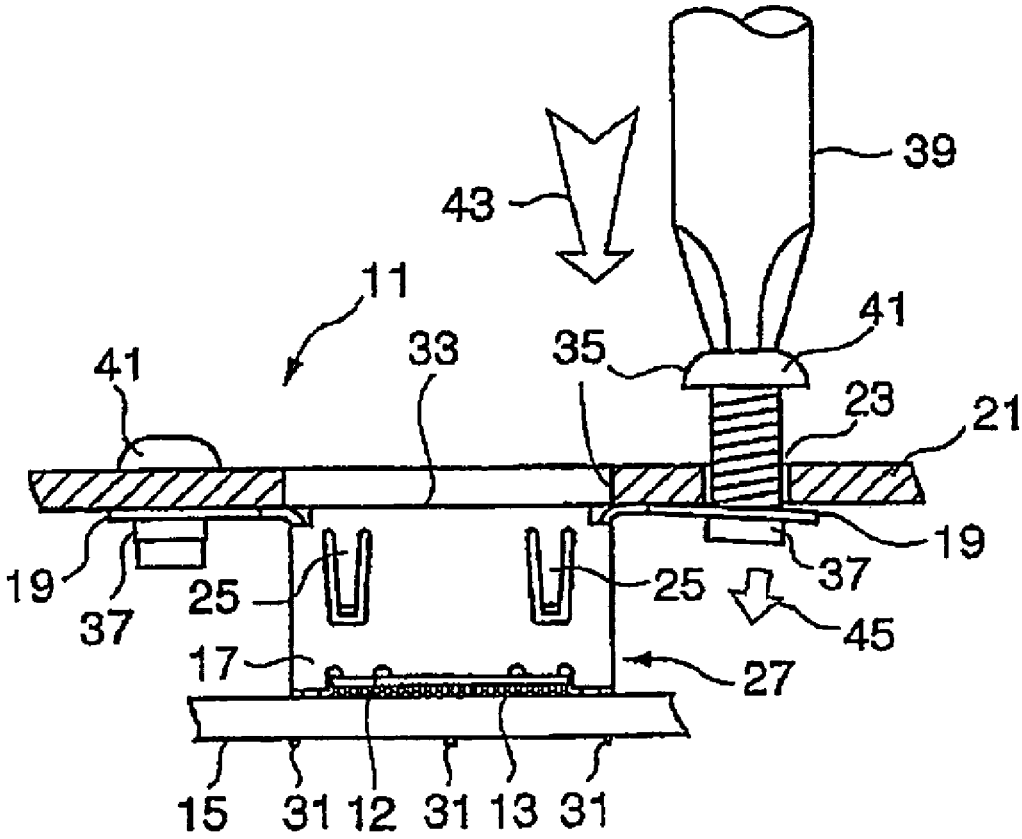

[FIG. 3]
(a)
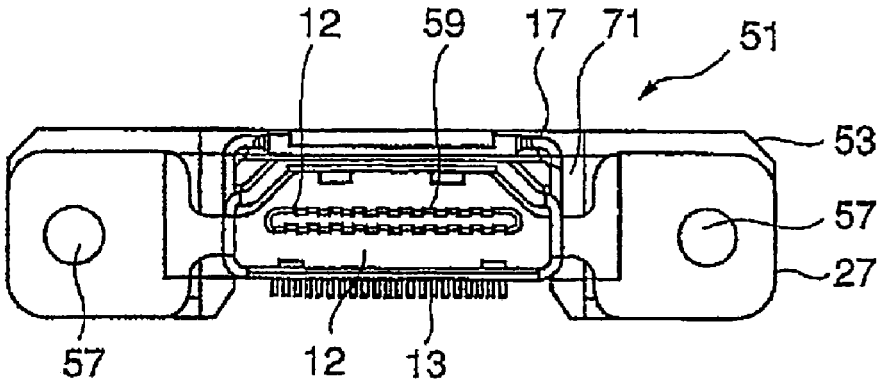
(b)
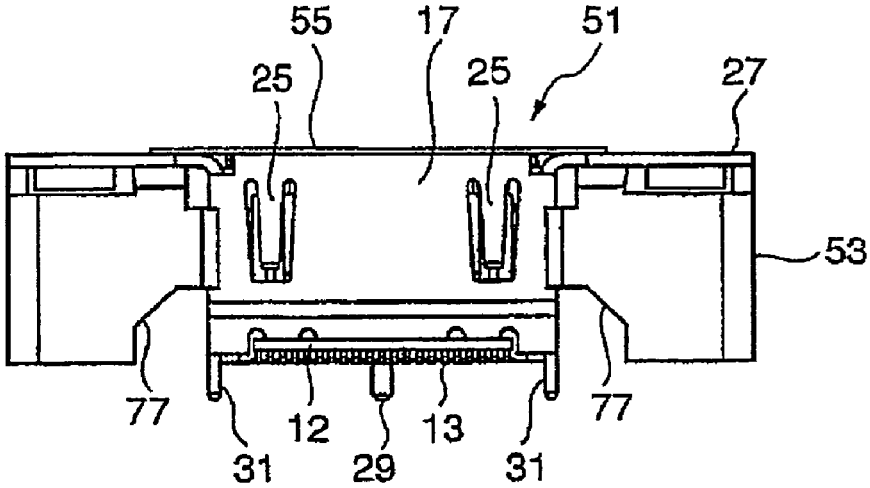
(c)
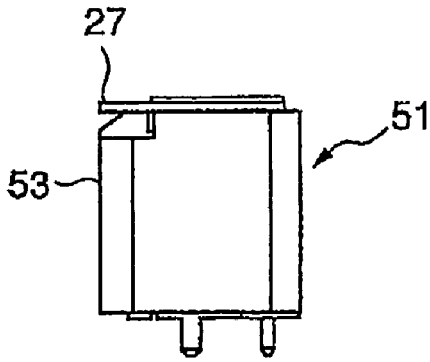

[FIG. 4]
(a)
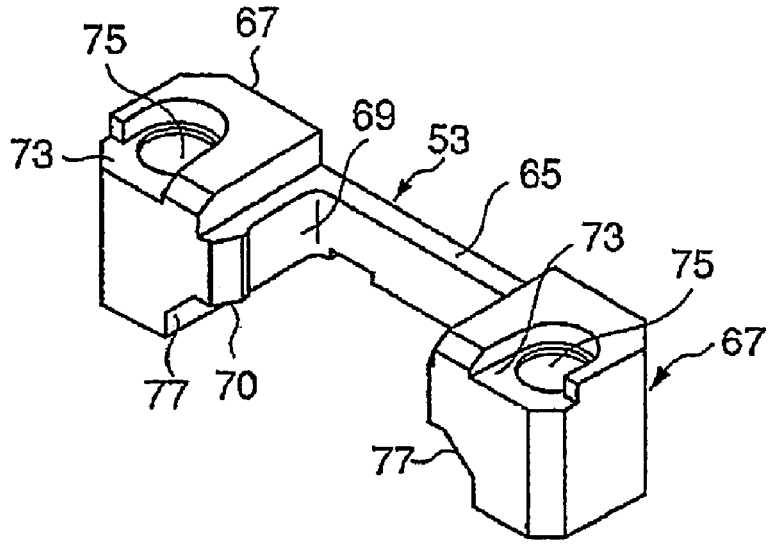
(b)
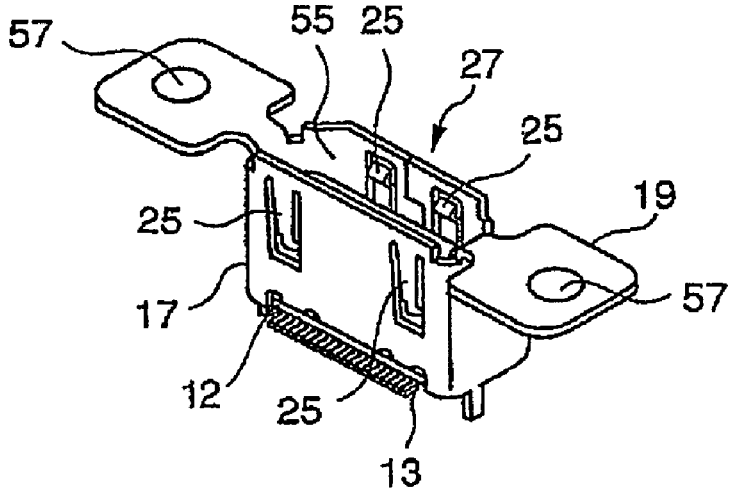
(c)
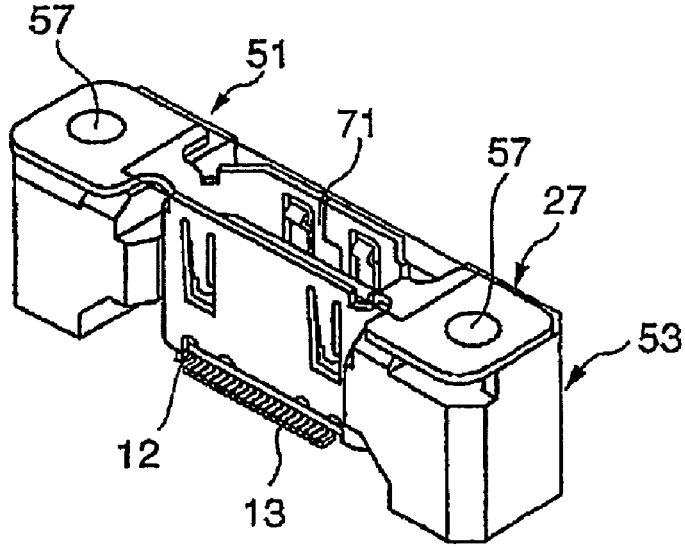

[FIG. 5]
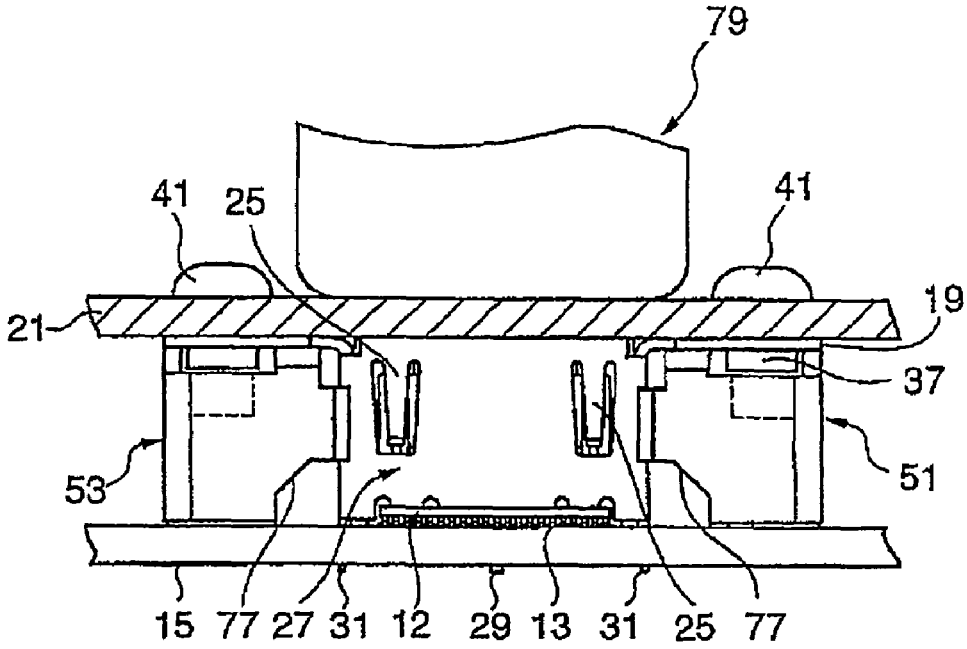
[FIG. 6]
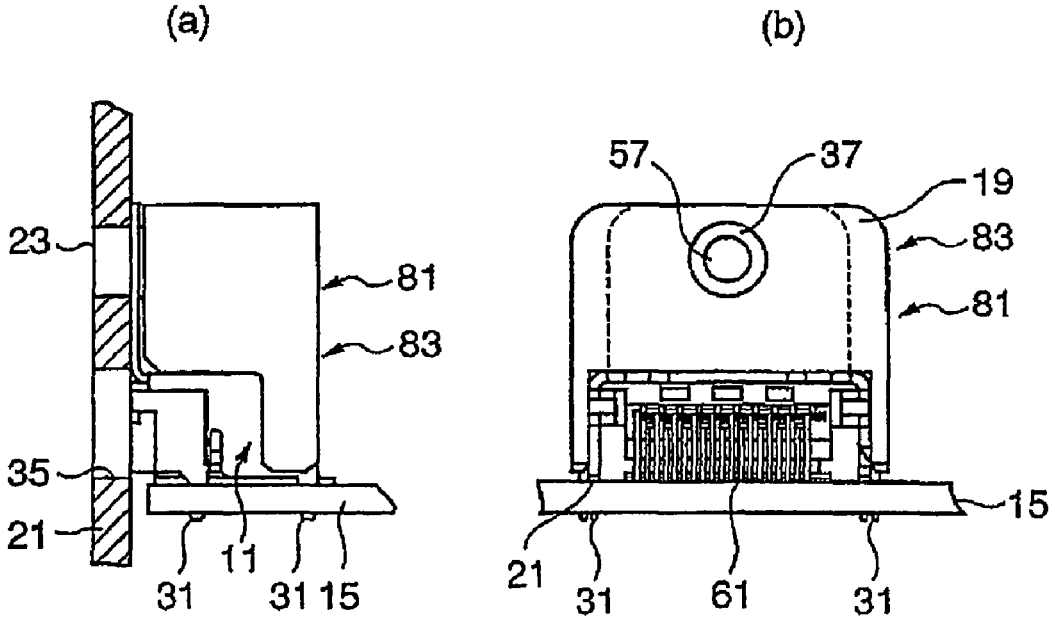

CONNECTOR

CROSS REFERENCE TO RELATED APPLICATIONS

Applicants claim priority under 35 U.S.C. §119 of Japanese Application No. 2004-183064 filed Jun. 21, 2004. Applications also claim priority under 35 U.S.C. §365 of PCT/JP2005/011123 filed Jun. 17, 2005. The international application under PCT article 21(2) was not published in English.

TECHNICAL FIELD

This invention relates to an electrical connector used for an I/O connector of an electronic device and, more specifically, relates to an electrical connector with a flange to be attached to a frame, a panel, or the like of an electronic device, the electrical connector having a reinforcing member.

BACKGROUND ART

Conventionally, it is usual that, for EMI measure and ensuring mechanical strength, a connector of this type is provided with a tapped metal flange and a frame (panel) on the electronic device side and the flange of the connector are screwed together. As the I/O connector provided at an opening of a panel, a board, or a casing or frame of an electrical device, or the like in this manner, there is conventionally one disclosed in each of Patent Document 1 and Patent Document 2.

The connector shown in each of Patent Document 1 and Patent Document 2 is a connector called the right angle connection type (hereinafter referred to as Prior Art 1).

The connector according to Prior Art 1 includes a Connector body and a shell forming the contour. On the other hand, on the front side of the shell is provided a flange standing upright integrally with the shell. On the lower side of the shell, project portions are provided which pass through a board and fixed by soldering on the back side. The flange is screwed to an attaching panel on the front side and it is configured that an opening portion of the connector can be observed through an opening of the panel.

On the other hand, an I/O connector called the perpendicular connection type (hereinafter referred to as Prior Art 2) includes a shell forming the contour of a connector body. The shell is integrally provided with flanges at its upper end and provided with projecting portions projecting downward at its lower end. Further, at the upper surface of the connector body, a fitting portion is provided which is adapted to be fitted to a mating plug connector. The flanges are provided on both sides of the fitting portion for fixation by matching an opening portion of a panel. The projecting portions projecting from the lower end of the shell are inserted into through-holes formed in a board and are fixed by soldering or the like. A boss portion is provided so as to project on a surface of each flange opposite to its fixing side and a screw is screwed through the boss portion from the fixing side so as to be provided on the inner surface of the boss portion.

In the case of the connector according to each of Prior Arts 1 and 2, the width of a connecting portion of the flange connected to the shell forming the contour cannot be increased due to restriction in opening shape between fitting portions thereof. Therefore, the screwing is carried out by the use of an electric driver or the like. There has been a problem that, due to strong pushing of the electric driver in device assembly, the flange is bent or deformed before being screwed and hence the screwing cannot be achieved.

On the other hand, in the case of the connector according to each of Prior Arts 1 and 2, if the flange is strengthened, the flange is hardly deformed during the screwing. However, particularly in the case of the miniature connector, even if the strength of the joining portion with the flange is large, there is a possibility that an excessive pushing force with the driver affects the soldered portions of the connector to thereby generate solder cracks.

Further, the connector itself increases in size and also increases in weight due to the flange having such a large strength, which is thus the unnecessary structure for a user who does not strongly push the driver.

Patent Document 1:

Japanese Unexamined Patent Application Publication No. 2000-260528

Patent Document 2:

Japanese Unexamined Patent Application Publication No. H10-340761

DISCLOSURE OF THE INVENTION

Problem to be Solved by the Invention

Therefore, it is an object of this invention to provide, in connection with an electrical connector with a flange, a connector that can prevent deformation of the flange at the time of fixation thereof.

It is another object of this invention to provide a connector that can also prevent a solder crack of a connector soldered portion by relieving an excessive pushing force by a mating connector to a board.

Further, it is still another object of this invention to provide a connector increased in strength without changing the structure of a connector body.

Means Undertaken to Solve the Problem

According to this invention, there is provided a connector which includes a connector body and a reinforcing member. The connector body includes an elongated conductive contact, an insulator holding the contact, and a shell surrounding the insulator. The shell has a flange formed with a screw hole for fixing the connector to an attaching object. In the connector of the present invention, the reinforcing member includes a reinforcing portion contacting the flange provided with the screw hole and an engaging portion engaging the shell. The reinforcing member is detachably fitted to the connector body.

In this invention, it is preferred that the connector is used while being mounted on a board.

In this invention, It is preferred that a mounting surface of said board and an attaching surface of said attaching object cross each other.

In this invention, it is preferred that the connector is mounted on the board and a mounting surface of said board and an attaching surface of said attaching object are parallel to each other.

In this invention, it is preferred that the shell is made of metal.

EFFECT OF THE INVENTION

According to this invention, it is possible to provide, in connection with an electrical connector with a flange, a miniature connector that can prevent deformation of the flange by fitting a reinforcing member into the connector at the time of fixation thereof.

Further, according to this invention, it is possible to provide a connector that can prevent a solder crack of a connector soldered portion by relieving to a board an excessive pushing force by a mating connector and a strong screw pushing force by a driver at the time of attachment.

Moreover, according to this invention, it is possible to provide a connector increased in strength by fitting a reinforcing member without changing the structure of a connector body.

BRIEF DESCRIPTION OF THE DRAWINGS

FIG. 1 is a side sectional view showing a connector according to Prior Art 1.

FIG. 2 is a front portion sectional view showing an I/O connector according to Prior Art 2.

FIG. 3 (*a*) is a plan view showing a connector according to a first embodiment of this invention, FIG. 3 (*b*) is a front view of the connector of FIG. 3 (*a*), and FIG. 3 (*c*) is a side view of the connector of FIG. 3 (*a*).

FIG. 4 (*a*) is a perspective view of a reinforcing member, FIG. 4 (*b*) is a perspective view of a connector body, and FIG. 4 (*c*) is a completed diagram of the connector obtained by engaging the reinforcing member of FIG. 4 (*a*) with the connector body of FIG. 4 (*b*).

[FIG. 5] A front portion sectional view showing the using state of the connector of FIG. 3 (*a*), FIG. 3 (*b*), and FIG. 3 (*c*).

FIG. 6 is a diagram showing a connector according to a second embodiment of this invention, wherein (a) is a side portion sectional view showing the state where the connector is attached to a panel and (b) is a front view of the connector of (a) with the panel removed.

DESCRIPTION OF SYMBOLS

11, 27, 51, 81 connector (body)
13 contact
15 board
17 shell
19 flange
21 panel
23 screw hole
25 fixing spring
29 positioning pin
31 projecting portion
35 opening
37 boss portion
41 screw
53 reinforcing member
59 fitting portion
65 engaging portion
67 screw reinforcing portion
69 inner periphery
70 engaging projection
71 adhesive tape
73 hollowed portion
75 screw hole
77 cutout portion
79 plug connector

BEST MODE FOR CARRYING OUT THE INVENTION

Prior to describing connectors according to embodiments of this invention, the connectors of Prior Arts 1 and 2 will be described with reference to FIGS. 1 and 2.

Referring to FIG. 1, the connector according to Prior Art 1 is a connector called the right angle connection type (see Patent Documents 1 and 2). The connector 11 according to Prior Art 1 has projecting portions 31 of a shell 17 on the bottom side, which pass through a board 15 and are fixed by soldering on the back side. On the front side is provided a flange 19 that is integrally provided with the shell 17 forming the contour. The connector 11 is configured such that the front side can be observed through an opening 23 of a panel 21 serving as an attaching member.

On the other hand, referring to FIG. 2, the I/O connector 11 according to Prior Art 2 is called the perpendicular connection type. The connector 11 according to Prior Art 2 has projecting portions 31 projecting from the lower end of a connector body 27 and the lower end of a shell 17, which are inserted into through-holes formed in a board and are fixed by soldering or the like. Further, at the upper surface of the connector body 27, there is provided a fitting portion 33 adapted to be fitted to a non-illustrated mating plug connector. On both sides of the fitting portion 33, there are provided flanges 19 for fixation by matching an opening portion 35 of a panel 21. A boss portion 37 is provided so as to project on a surface of each flange 19 opposite to its fixing side. A screw 41 is screwed through the boss portion 37 from the fixing side so as to be provided on the inner surface of the boss portion 37. On the front and rear surfaces of the shell 17, fixing springs 25 are formed by slitting such that one end of each spring projects inward describing a "<-shape", i.e. an obtuse angular shape, so as to be pressed against the mating connector when the connector 11 is fitted.

In the case of the connector 11 according to each Prior Art, the width of a connecting portion of the flange 19 connected to the shell 17 forming the contour cannot be increased due to restriction in opening shape between fitting portions thereof.

As indicated by an outline arrow 43 in each of FIGS. 1 and 2, screwing by the use of an electric driver in device assembly is carried out by strongly pushing a driver 62. However, there has been a problem that, in terms of the strength of the connecting portion, the flange 19 is subjected to a force indicated by an arrow 45 so as to be bent or deformed before being screwed by the screw 41, so that the screwing cannot be achieved.

On the other hand, in the case of the connector 11 according to each Prior Art, if the flange 19 is strengthened, the flange 19 is hardly deformed during the screwing. However, particularly in the case of the miniature connector, even if the strength of the joining portion with the flange 19 is large, there is a possibility that an excessive pushing force with the driver 39 affects the soldered portions of the connector 11 to thereby generate solder cracks.

Further, the connector itself increases in size due to the flange 19 having such a large strength. In addition, the connector itself also increases in weight, which is thus the unnecessary structure for a user who does not strongly push the driver.

Now, the embodiments of this invention will be described with reference to FIGS. 3 to 6.

Referring to FIG. 3 (*a*) to FIG. 3 (*c*) and FIG. 4 (*a*) to FIG. 4 (*c*), a connector 51 according to the first embodiment is used as an I/O connector of an electronic device and the illustrated connector is called the perpendicular connection type. The connector 51 includes a connector body 27 and a reinforcing member 53 being a single molded component fitted to the connector body 27. The reinforcing member 53 made of either resin or metal can be used as long as it has elasticity.

As best shown in FIG. 4 (*b*), the connector body 27 has a box-shaped metal shell 17, an opening, and flanges 12. The shell 17 is box-shaped and made of metal. The opening forms a fitting portion 55 on the upper side of the shell 17. The flanges 19 are provided so as to extend on both sides of the opening and are each in the form of a flat plate having a screw hole 57 at its center.

As shown in FIG. 3 (*a*), elongated metal contacts 13 are provided inside the opening. In FIG. 3 (*a*), it is seen that there are provided only plate-shaped connecting portions 59 arranged in two rows of upper and lower surfaces. The connecting portions 59 are fitted to a non-illustrated mating plug connector.

On the lower side of the shell 17, the contacts 13 are disposed while exposing portions thereof that serve as terminals when actually mounted on a board.

On the front and rear surfaces of the shell 17, fixing springs 25 are formed by slitting such that one end of each spring projects inward describing a "<-shape", i.e. an obtuse angular shape, so as to be pressed against the connector when that connector is fitted.

Further, a positioning pin 29 and projecting portions 31 adapted to be mounted on the board are respectively provided so as to project downward from the lower end of the shell 17.

As best shown in FIG. 4 (*a*), the reinforcing member 53 includes an engaging portion 65 and screw reinforcing portions 67 provided on both sides thereof. The engaging portion 65 has a U shape or a generally "Π shape", i.e. a U-shape lying on one side. At end portions of an inner periphery 69 of the engaging portion 65, engaging projections 69 are provided each of which is in the form of a generally triangular protrusion adapted to engage the outer periphery of the shell 17 of the connector body 27 when the connector body 27 is received.

The screw reinforcing portions 67 each include a screw hole 75, a hollowed portion 73 that is hollowed in a region including and surrounding the screw hole 75 and opened to the front, and a cutout portion 77 formed by cutting out a front inner corner side.

As best shown in FIG. 4 (*c*), the reinforcing member 53 is fitted from the rear side of the connector body 27. The shell 17 of the connector body 27 is inserted in the inner periphery 69 of the engaging portion 65 of the reinforcing member 53. By the insertion of the shell 17, the engaging portion 65 expands to increase its inner space. At the time of completion of the reception of the shell 17, the engaging portion 65 is elastically deformed to reduce its inner space. Therefore, as shown in FIG. 4 (*c*), engaging projections 70 engage the front left and right corners of the shell 17 to prevent separation or slipping-off of the shell 17 so that the connector 51 is in an assembled state. In FIG. 5 (*a*) and FIG. 6 (*c*), a portion 71 given oblique lines at the upper surface of the connector 51 is adhesive tape for automatic mounting and is discarded after solder reflow. For further fixation of the reinforcing member 53, use can be made of any of mechanical fixation, adhesives, and so on.

Referring to FIG. 5, the connector 51 is in a mounted state where its bottom is fixed to a board 15. At the upper surface of the connector 51, the fitting portion 55 is registered with a non-illustrated opening of a frame or a panel 21 of an electronic device. Then, by screwing the screws 41 into a screw holes 23 of the reinforcing member 53 from the panel 21, the connector 51 is fixed to the panel 21. A plug connector 79 is inserted into the opening (not shown) of the panel 21 so as to be in a state of being fitted to the connector 51.

As described above, the reinforcing member 53 is provided for filling space portions between the board 15 and the flanges 19. When the flange 19 is subjected to deformation due to the insertion of the screw 41, the reinforcing member 53 serves to relieve the stress to the board 15 through the reinforcing member 53, thereby preventing the deformation of the flange 19.

If the strength of the reinforcing member 53 and the connector body 27 is large, a pushing force of a driver 61 can be borne by the reinforcing member 53 and the connector body 27. Therefore, the reinforcing member 53 is configured so as not to be located close to the board 15. Further, since the reinforcing member 53 is a component separate from the connector body 27, the reinforcing member 53 can be attached or detached according to necessity without changing the structure of the connector.

Referring to FIG. 6 (*a*) and FIG. 6 (*b*), a connector 81 according to the second embodiment is called an I/O connector of the horizontal (right angle) connection type. This connector 81 is used as an I/O connector of an electronic device. The connector 81 includes a connector body 11 having the same structure as that of the connector 11 according to Prior Art shown in FIG. 1 and further includes a reinforcing member 83 mounted so as to cover the connector body 11 from behind on its outside. The reinforcing member 83 elastically deforms its portion adapted to embracingly hold the outer periphery of the connector body 11 or its entire body, so as to be easily fitted to the connector body and held.

The reinforcing member 83 is provided with a hole portion 57 adapted to receive therein a boss portion 37 of a flange 1 at the upper front. Accordingly, deformation of a flange 19 due to insertion of a screw 41 can be prevented.

INDUSTRIAL APPLICABILITY

As described above, the connector according to this invention is applied, as an electrical connector with a flange, to an I/O connector provided at an opening of a panel, a board, or a casing or frame of an electrical device, or the like.

The invention claimed is:

1. A connector comprising a connector body and a reinforcing member, said connector body comprising an elongated conductive contact, an insulator holding said contact, and a conductive hollow shell surrounding said insulator, said shell having a flange formed from a top edge of said shell and having a screw hole to be connected with a boss portion for fixing the connector to a panel to be fixed, said connector being used for mounting on a substrate, said reinforcing member comprising reinforcing portions provided between said panel and the substrate and contacting said flange, and an engaging portion connecting between said reinforcing portions engaging side walls of said shell, wherein three side walls of said shell have three faces surrounded by said engaging portion, said engaging portion being elastically deformable to expand and reduce to an original position when engaged with the shell so that said reinforcing member is detachably fitted to said connector body, wherein each of said reinforcing portions extends along the respective side wall of the shell from a top to a bottom of the respective side wall of the shell.

2. The connector as claimed in claim 1, wherein said engaging portion includes a pair of engaging projections.

* * * * *

UNITED STATES PATENT AND TRADEMARK OFFICE

CERTIFICATE OF CORRECTION

PATENT NO. : 7,731,532 B2
APPLICATION NO. : 10/585544
DATED : June 8, 2010
INVENTOR(S) : Masumoto et al.

It is certified that error appears in the above-identified patent and that said Letters Patent is hereby corrected as shown below:

In particular, in Column 1, line 34, after the word "a" please change "Connector" to correctly read: --connector--.

In Column 5, line 6, after "13" please insert: --held by an insulator 12--.

Signed and Sealed this

Twenty-eighth Day of September, 2010

David J. Kappos

David J. Kappos
*Director of the United States Patent and Trademark Office*